US005094060A

United States Patent [19]

Caird

[11] Patent Number: 5,094,060

[45] Date of Patent: Mar. 10, 1992

[54] BASKET AND BASKET INSERT AND METHOD FOR PACKAGING PLANTS

[75] Inventor: Ronald M. Caird, Santa Barbara, Calif.

[73] Assignee: W.J. Griffin, Inc., Santa Barbara, Calif.

[21] Appl. No.: 557,909

[22] Filed: Jul. 25, 1990

[51] Int. Cl.[5] ..... B65D 85/50; B65B 25/02

[52] U.S. Cl. ..... 53/390; 53/443; 206/423; 206/563; 220/410

[58] Field of Search ..... 53/390, 449, 443, 171; 206/423, 563, 562, 589; 220/410, 23.86

[56] References Cited

U.S. PATENT DOCUMENTS

| | | | |
|---|---|---|---|
| 1,904,072 | 4/1933 | Nelson et al. | 206/563 X |
| 3,028,005 | 4/1962 | Shaffer | 206/423 |
| 3,660,934 | 5/1972 | Pollack et al. | 206/423 X |
| 3,682,347 | 8/1972 | Barrier | 206/423 |
| 3,810,329 | 5/1974 | Lecuru et al. | 206/423 X |
| 4,170,301 | 10/1979 | Jones et al. | 206/423 |
| 4,684,013 | 8/1987 | Jacobs | 220/23.86 X |

FOREIGN PATENT DOCUMENTS

| | | | |
|---|---|---|---|
| 2756814 | 6/1978 | Fed. Rep. of Germany | 206/563 |

OTHER PUBLICATIONS

Three photographs of a plant pot tray (no date) (submitted by applicant, 12/3/90).

*Primary Examiner*—James F. Coan

*Attorney, Agent, or Firm*—Spensley Horn Jubas & Lubitz

[57] ABSTRACT

The present invention relates to a basket, an insert and a method for packaging and displaying flowers and other potted plants in baskets of various shapes and sizes. The insert of the present invention comprises a base which includes at least one cavity for receiving a pot. The insert also comprises a flange which comes in contact with the inside perimeter of the basket to stabilize the insert in the basket.

26 Claims, 7 Drawing Sheets

BASKET AND BASKET INSERT AND METHOD FOR PACKAGING PLANTS

BACKGROUND OF THE INVENTION

1. Field of the Invention

This invention relates to a device and method for packaging and in particular for packaging plants in baskets.

2. Description of the Related Art

Baskets are known for the packaging and display of flowers and other potted plants. Thousands of baskets are filled with potted plants at nurseries daily and shipped to markets for sale. Oftentimes, however, the pots move around during transport inside the basket and spill sometimes causing damage to the plant. To attempt to solve this problem it has been known to stuff newspapers clippings or artificial grass between the pots to prevent them from shifting. Unfortunately, the grass or newspaper can be messy and unsightly, making the arrangement unattractive to perspective customers. It also takes a considerable amount of time to stuff the clippings in a large number of these baskets. Further, since the baskets are typically filled with pots by unskilled workers as fast as possible, the pot placement is generally not uniform. Moreover, such methods do not protect the basket from damage caused when water or soil leaks out of the hole in the bottom of the pots.

It is also known to line the basket with a plastic sheet and then add the pots, or plant directly in the basket without using a pot. However, in the event a plant is damaged during or after transport, it takes considerable time to transfer the damaged plants out of the basket, and to replant. Nor can a purchaser of the basket quickly substitute a particular plant for one already planted in the basket at the request of the purchaser. This method of displayinq plants in a basket also requires a significant amount of soil to fill the volume of a given basket.

Also known in the industry is a carrying tray or a sell pack. These trays or packs are typically used for growing seedlings. These trays are divided into any number of uniform sub-compartments for receiving pots of uniform size. Each sub-compartment has at least one hole in its bottom to facilitate proper watering by preventing the seedlings from being flooded. Also, each sub-compartment is uniform in depth.

Still another prior art device consists of a round outer pot which receives triangular, pie-slice-shaped inner pots. These inner pots are uniform in size and each one has a hole in the bottom. This configuration of pots is used for growing seedlings.

3. Some Objects of Invention

It is an object of an embodiment of the present invention to provide a device and a method for placing pots in a specific arrangement in a basket and preventing the pots from shifting and spilling.

Yet another object of an embodiment of the present invention is to provide a novel basket for receiving pots.

It is another object of an embodiment of the present invention to provide a device and method which facilitates the standardizing of the shape and size of baskets used for transporting and displaying plants by allowing for many combinations of arrangements within a standard size basket.

It is still another object of an embodiment of the present invention to eliminate the need for stuffing materials between the pots in a basket in order to stabilize the pots for transport and display.

It is yet another object of an embodiment of the present invention to provide a device and method which allows plants in baskets to be arranged and displayed at various elevations, or allows plants in different size pots to be displayed on the same level.

These and other objects are achieved by embodiments of the invention described below.

SUMMARY OF THE INVENTION

One aspect of the present invention is directed to a novel insert which allows a plurality of plant pots or other objects to be packed in a basket for transport and display in a uniform arrangement, and which prevents the shifting and spilling of the plant pots or objects. The insert of an embodiment of the present invention comprises a base which includes at least one cavity for receiving a pot or object. The insert also comprises a flange which extends from the base and contacts a portion of the sides of the basket to thereby stabilize the insert in a fixed position in the basket.

In another aspect of the present invention, the insert and basket are one piece.

In yet another aspect of the present invention, a packaging process is provided including the steps of positioning the inserts in baskets, placing potted plants in the inserts, and placing a maximum number of baskets in boxes of uniform size.

DETAILED DESCRIPTION OF THE PREFERRED EMBODIMENTS

This invention is described with respect to the preferred physical embodiments constructed in accordance herewith. It will be apparent to those skilled in the art that various modifications and improvements may be made without departing from the scope and spirit of the invention. Accordingly, the invention is not limited by the specific embodiments illustrated and described, but only by the scope of the appended claims.

The insert of an embodiment of the present invention relates to a novel design for packaging and displaying flowers, potted plants and other items in baskets of various shapes and sizes. For illustrative purposes only, the invention is described with respect to an insert embodiment capable of holding four pots of different sizes. The present invention, however, encompasses any insert capable of quickly and neatly securing any number of pots or items in a basket or similar receptacle.

Figure 1:
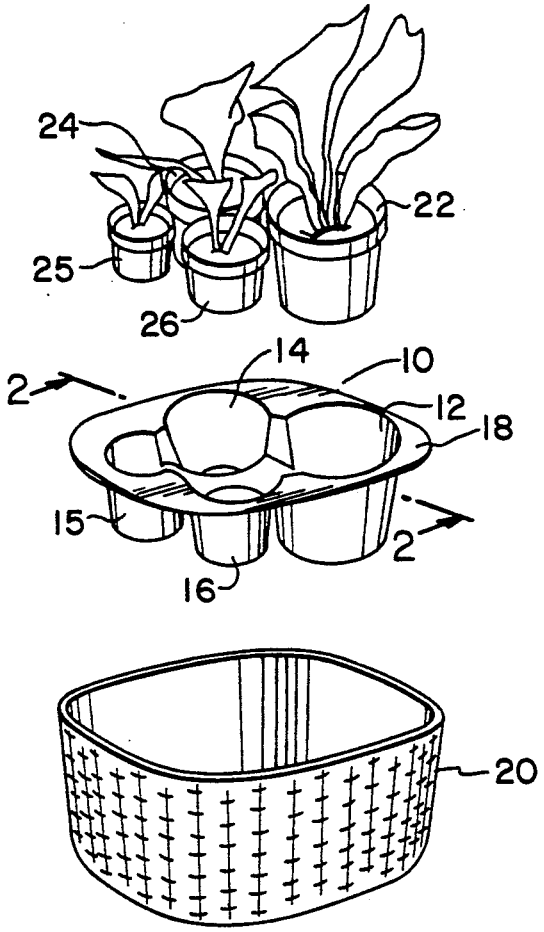
FIG. 1 is an exploded view showing one embodiment of the insert of the present invention between flower pots and a basket.

FIG. 1 shows insert 10 of an embodiment of the present invention in relation to basket 20 and pots 22, 24, 25, and 26. Insert 10 comprises cavities 12, 14, 15 and 16, and flange 18 extending from the periphery of the cavities. A bridging portion 40 between the cavities is shown in a variety of positions in FIGS. 2–14.

Insert 10 can be made by a Variety of methods; however, molding is preferred. To do so, polyethylene film of a suitable thickness is fed through a heating chamber. The warmed and pliable material is then placed over ceramic molds of the desired shape, and then lowered to cover the molds. Water is then sprayed over the material to cool the material which is then cut, with the flanges shaped to basket dimensions. Insert 10 can also be blow molded from any suitable plastic.

Although polyethylene is preferred, other materials are within the scope of the present invention such as other plastics, metals, foils and glass just to name a few. The insert can also be colored to blend in with the basket or for other purposes. The insert is preferably flexibly thin; however, thicker versions are also within the scope of the present invention. Thicknesses ranging from 0.0025–0.03 inches are within the scope of the present invention with 0.005–0.01 preferred.

As seen in FIG. 1, cavities 12, 14, 15 and 16 are of different or non-uniform sizes. The present invention, however, also encompasses an insert having cavities of uniform size. It is also apparent that cavity 12 descends lower than cavity 14. Likewise, cavity 14 descends to a different level than does cavity 16. Thus, the present invention encompasses cavities that are uniform or non-uniform in depth. This allows compensation for pots of varying heights to make them appear to be on the same level in the basket, or alternatively, to purposely raise certain pots above others to give a natural garden look to the basket. In this vein, the insert ID can also include a protruding mountain shaped portion having therein cavities for pots or other articles such as for example bottles as discussed below.

Figure 3:
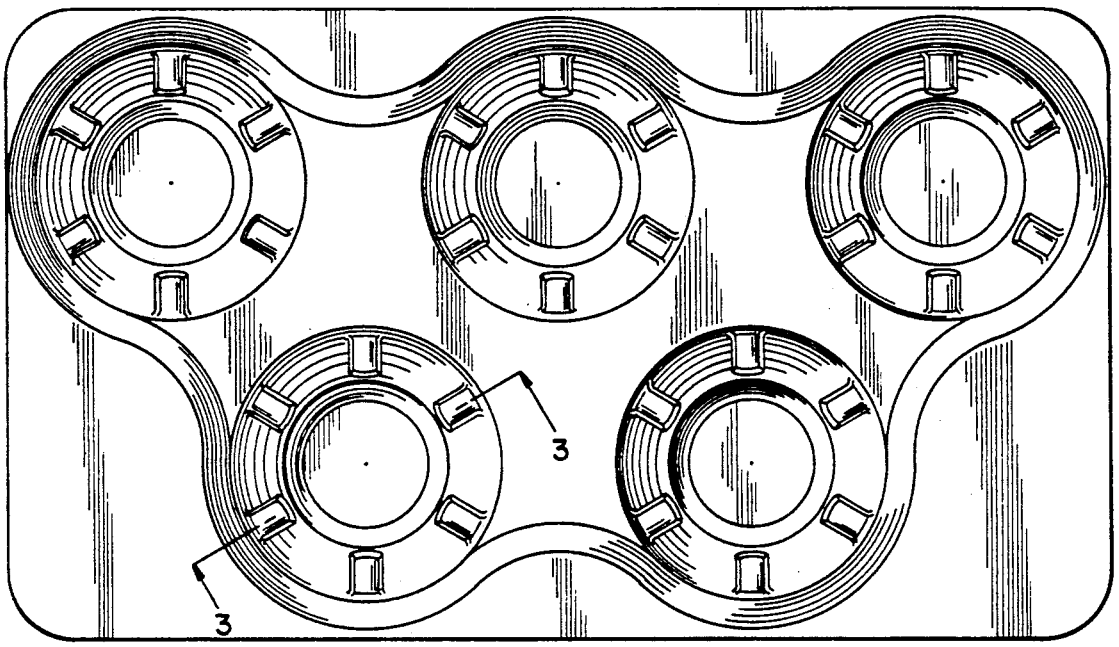
FIG. 3 is a top view of another embodiment of the insert of the present invention.
Figure 4:
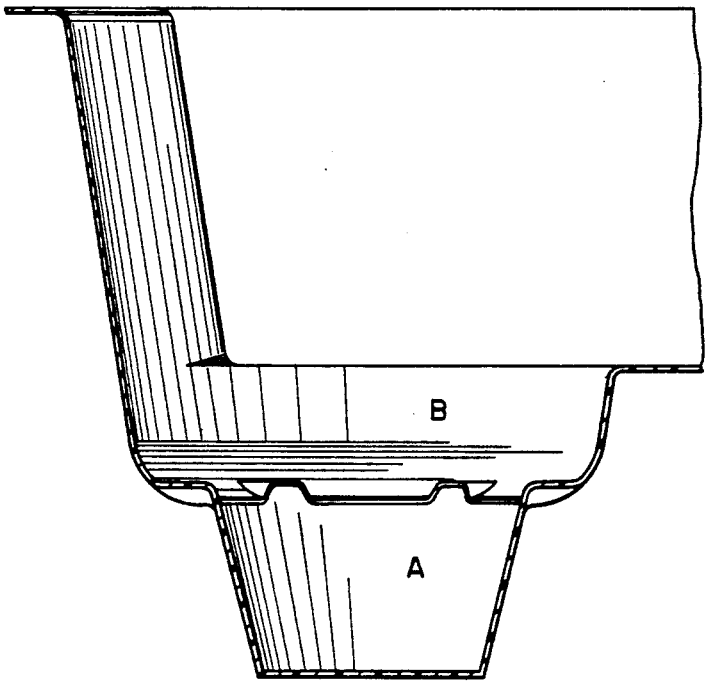
FIG. 4 is a cross-sectional view taken along line 3—3 of FIG. 3.

It should be appreciated that the cavities of the inserts of the present invention may have varying diameters. For example, FIGS. 3–4 show cavities of two sections "A" and "B", with section "A" corresponding to the base of pot and section "B" corresponding to the lip of a pot.

Figure 5:
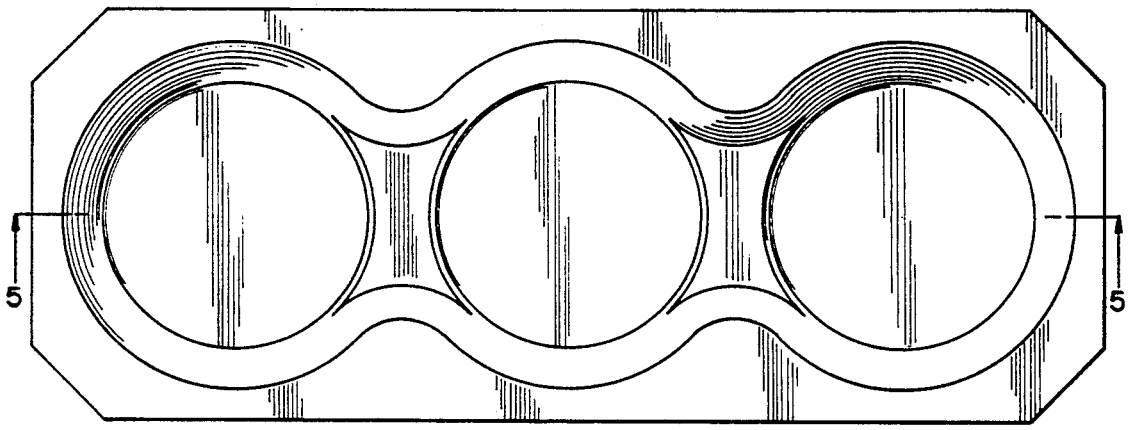
FIG. 5 is a top view of another embodiment of the insert of the present invention.
Figure 6:
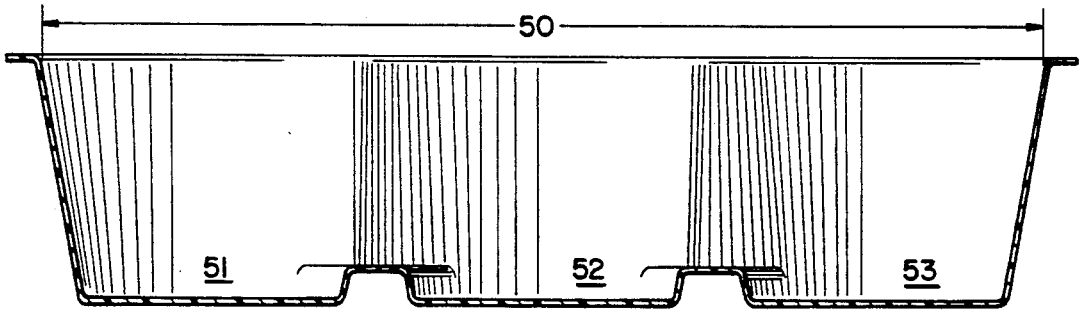
FIG. 6 is a cross-sectional view taken along line 5—5 of FIG. 5.
Figure 7:
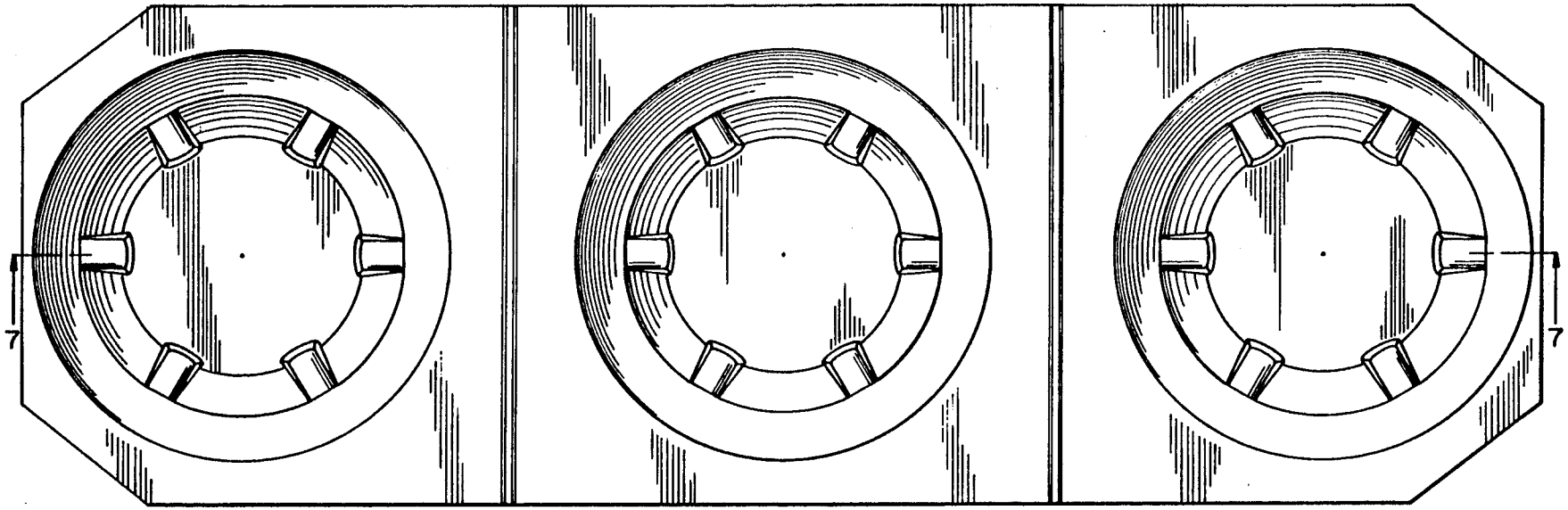
FIG. 7 is a top view of another embodiment of the present invention.
Figure 8:
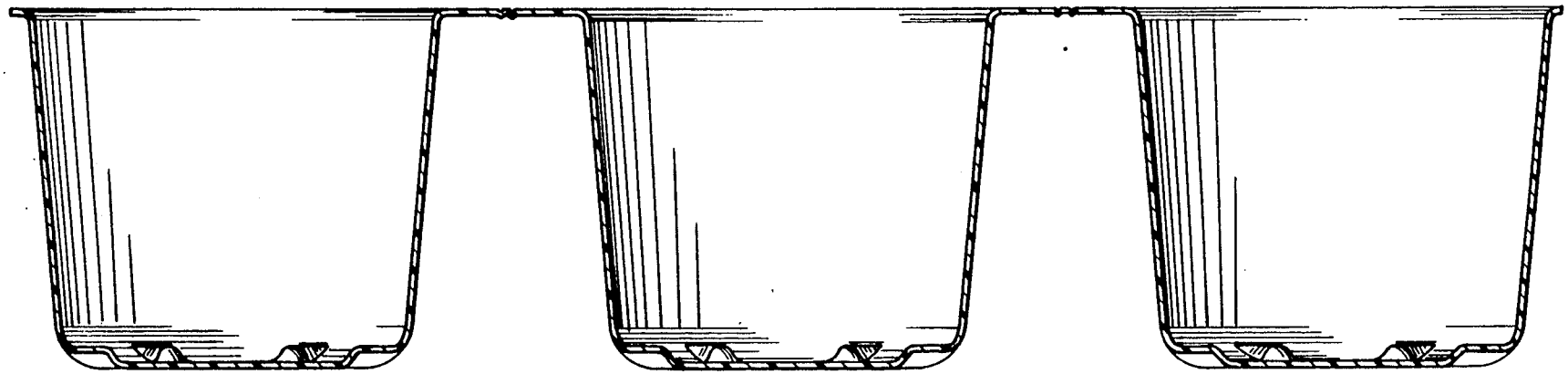
FIG. 8 is a cross-sectional view taken along line 7—7 of FIG. 7.

With reference to FIGS. 5–6, the top opening 50 of the insert may be large enough to allow the passage of several pots, with the cavities 51, 52 and 53 being shallow to accommodate the bottom of the base of pots.

Figure 9:
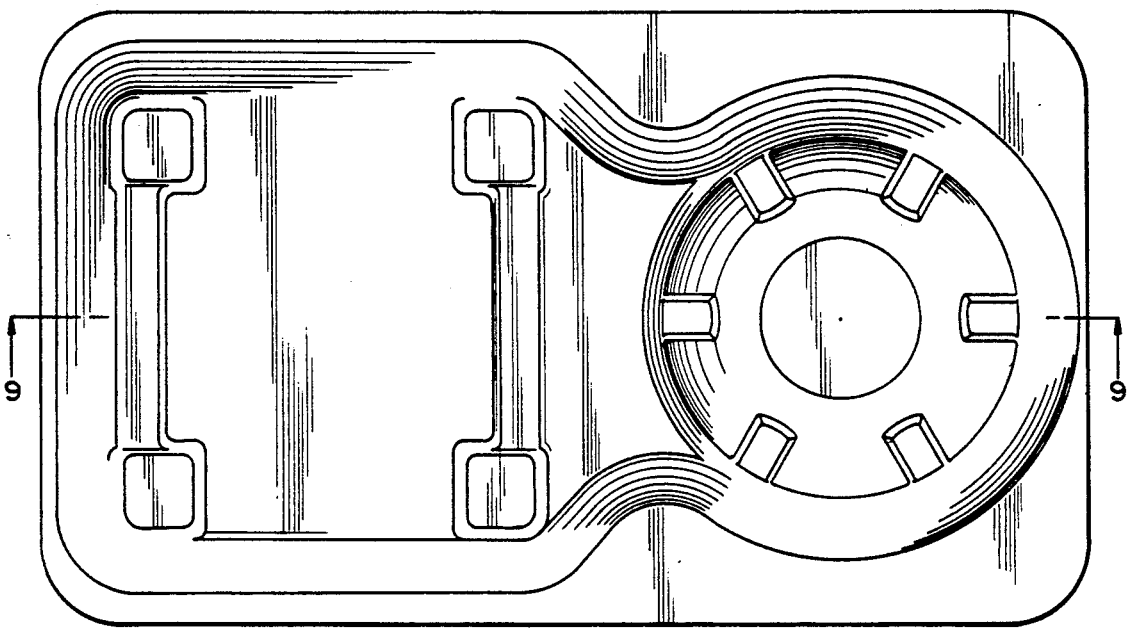
FIG. 9 is a top view of another embodiment of the present invention.
Figure 10:
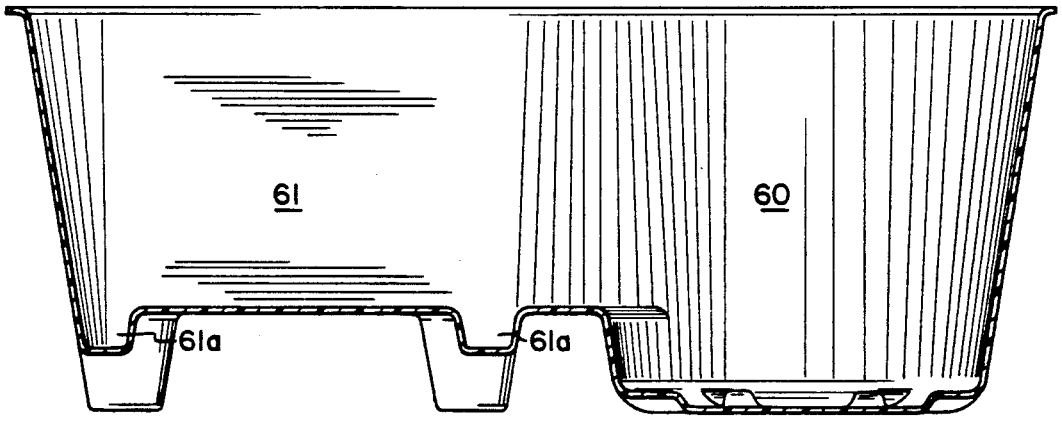
FIG. 10 is a cross-sectional view taken along line 9—9 of FIG. 9.
Figure 11:
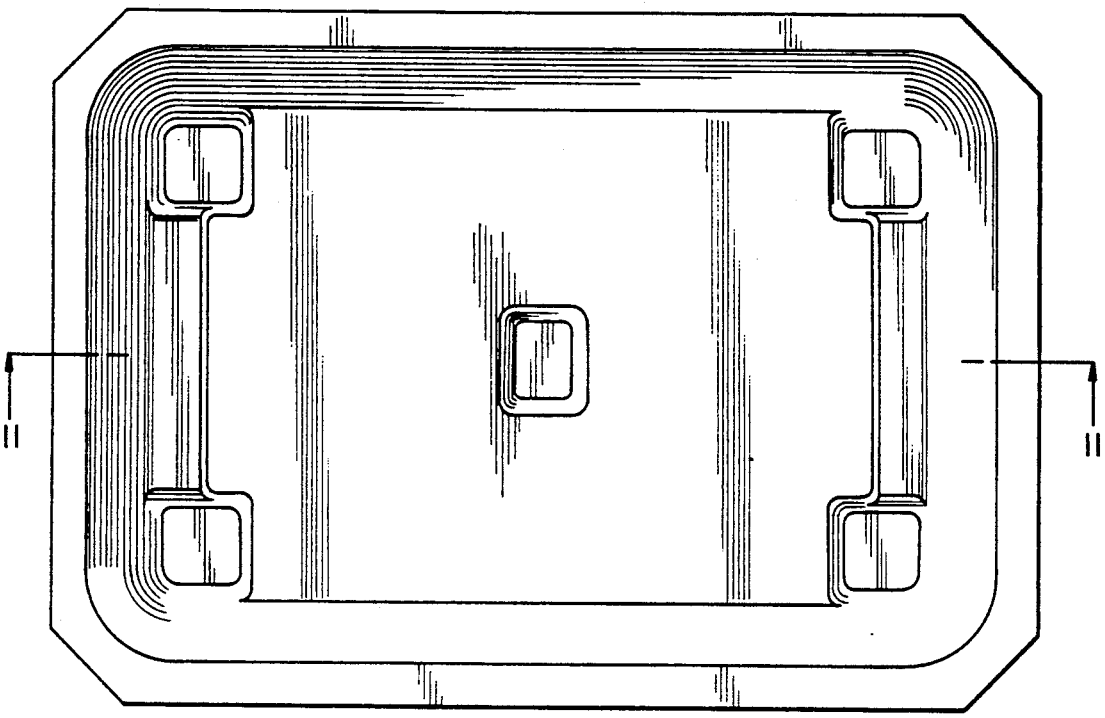
FIG. 11 is a top view of another embodiment of the insert of the present invention.
Figure 12:
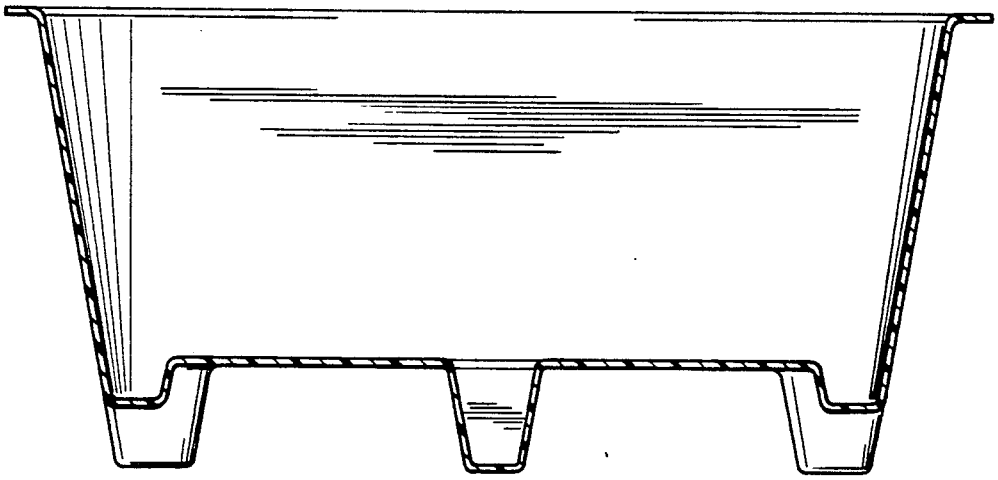
FIG. 12 is a cross-sectional view taken along line 12—12 of FIG. 11.
Figure 13:
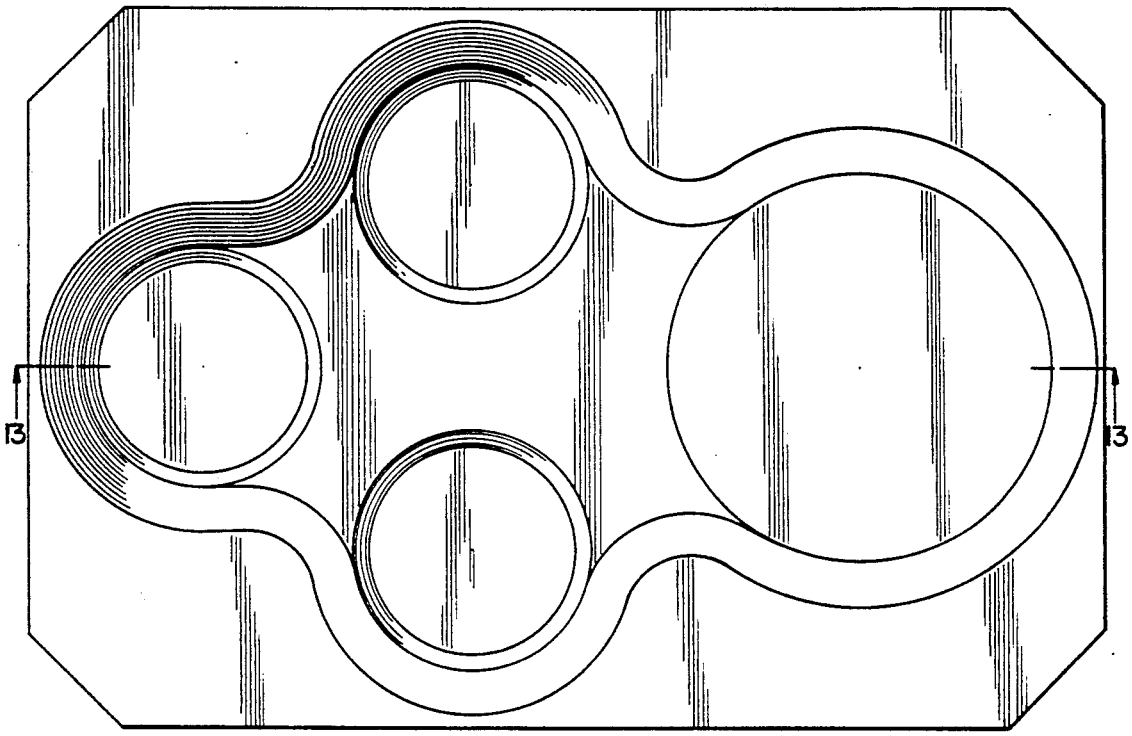
FIG. 13 is a top view of another embodiment of the present invention.
Figure 14:
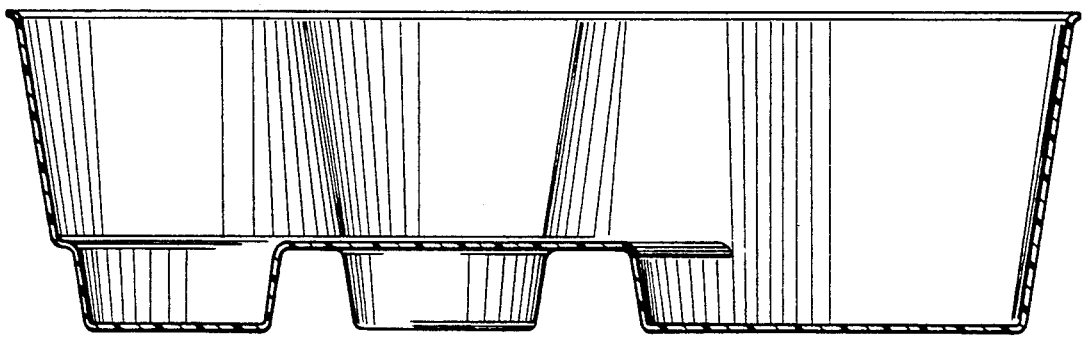
FIG. 14 is a cross-sectional view taken along line 13—13 of FIG. 13.

With reference to FIGS. 9–10, the insert can include a square shaped cavity 60 which opens into a rectangular shaped cavity 61. The cavity 61 can also include big indentations **61*a*** which are designed to receive legs of the pot (not shown), or to act as a receptacle for water seepage from the pot.

Flange 18 is shown to extend along the entire perimeter of insert 10 and to contact the walls of the basket. However, it should be appreciated that the flange could be designed such that only such portions of it contact the basket walls so as to stabilize the insert in a fixed position in the basket. In this regard, it is preferable that flange 18 have some rigidity so that when the insert is placed in the basket, a portion of the free edge of the flange sufficient to stabilize the insert in a fixed position in the basket is in intimate contact with the inside wall of the basket. Alternatively, the inside wall of the basket could include inwardly extending ridges upon which the flange is rested.

The primary function of flange 18 is to engage with basket 20 and stabilize insert 10. Flange 18 also helps to prevent dirt and water from dropping into and damaging basket 20. Additionally, flange 18 provides a platform on which artificial grass 30 or other decorations may be arranged. It should be appreciated that although the flange is preferably integral with the base, it could also be separate and connected to the base prior to use.

In another embodiment of the present invention, insert 10 is made an integral part of basket 20. In other words, insert 10 and basket 20 comprise a one-piece construction. In this case, basket 20 may be constructed of plastic, and roto molded as one-piece along with insert 10. This embodiment of the present invention could be made of a variety of materials including plastic, metal, wood, porcelain, dolomite, brass, or other ceramics. The outside of this embodiment of the invention could also be made decorative or be textured to look like a wicker or straw basket. Basket 20 may also be made of wicker, wood or other materials with insert 10 being separate but permanently attached inside the basket.

The advantages of the present invention are numerous. First of all, it can be made of varying shapes and sizes to stabilize potted plants quickly and easily within many different baskets. Secondly, insert 10 makes it very easy for packaging workers to produce large numbers of baskets having pots therein of a given arrangement. All that is required is to place a given pot, for instance pot 24, into the proper cavity, in this case, cavity 14. Another advantage is that if a plant dies while in transit or on display, it can be easily replaced without the mess of re-planting a substitute plant. Likewise, insert 10 allows customers to easily make their own arrangements which can lead to increased sales.

Another advantage of insert 10 over the prior art relates to the packaging of plants for transport to market. Insert 10 allows many different arrangements of plants to be made within a basket uniform in shape and size. This in turn allows the baskets to be packed in standard boxes which cuts down on packaging time and costs.

In considering the scope of the present invention, the following features, among others, should be considered:

1. In addition to potted plants, plants can be planted directly into the insert or basket cavities.

2. In addition to forming the cavities to snugly receive potted plants, the cavities can be formed to receive other items such as bottles of wine, stems of live or artificial flowers, statues, or virtually any other item to be displayed.

3. The cavities can be a variety of depths. Thus, the top of the pots can be made level, or certain pots can be raised or lowered with respect to others.

4. The insert is shown with no hole in the bottom of the insert defining the bottom 12*a*, 14*a* of the cavities as the insert is shown used with pots and not seedlings. However, it should be appreciated that holes can be placed in the walls of the insert defining the bottom of the cavities and seedlings grown in the cavities.

5. The invention as described above can include cavities or depressions for snugly receiving standard sized pots. Standard sized pots are well known in the industry and include standard round (width v. depth) of 2¼"×2¼", 2½"×2½", 3"×2 3/4", 3 ½"×3⅛", 4"×3 ⅝", 5"×5", 5½"×5½", 6"×6", and standard square of 2¼"×2", 2½"×2¼", 3"×2½", 3½"×3", 4"×3½", 4½"×4", and 4"×4".

6. The invention can also be used with fruit baskets, deli baskets, note cards, cosmetics, liquors, candy boxes, and other such objects.

Figure 2:
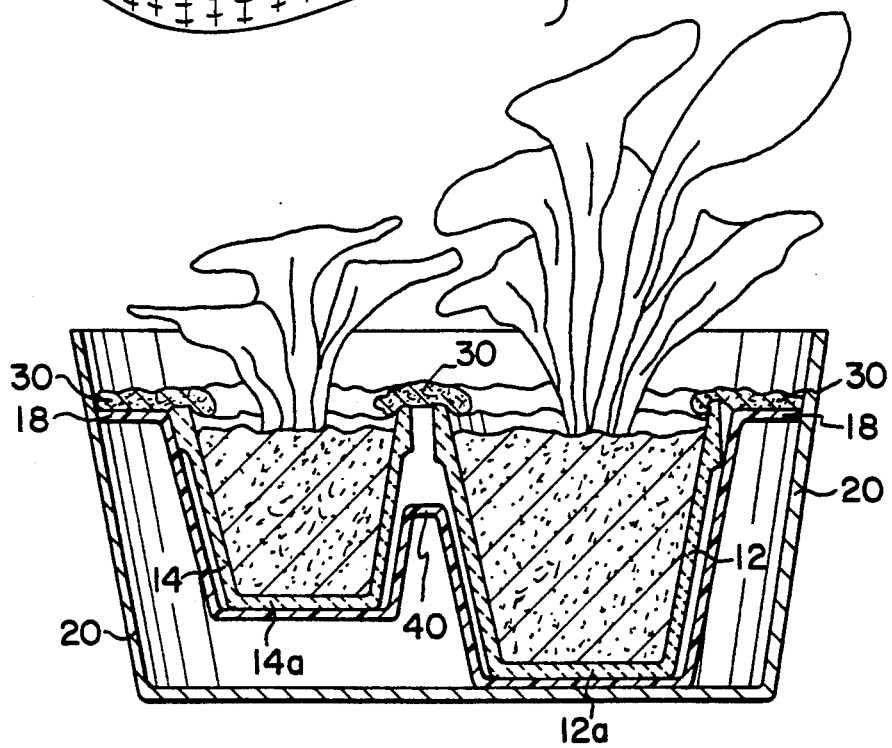
FIG. 2 is a cross-sectional view of the embodiment of the present invention shown in FIG. 1.

In addition to the insert 10 shown in FIGS. 1 and 2, other embodiments of the present invention are shown for illustration only in FIGS. 3–4.

I claim:

1. A method of packaging flowers and other plants, which comprises the steps of:

(a) positioning an insert having a base including a plurality of cavities and a flange extending from the base inside of a basket having an outer peripheral wall defining an inner surface and no more than one concave interior portion so that a portion of the flange is flush against the inner surface of the outer peripheral wall of the basket;

(b) placing potted plants within the cavities of the insert; and (c) packaging a maximum number of such baskets in boxes of uniform size.

2. A method of arranging pots in a basket, which comprises the steps of:

(a) positioning an insert having a base including a plurality of cavities and a flange extending from the base inside the basket so that a portion of the flange contacts the inside wall of the basket;

(b) placing pots within the cavities of the insert; and (c) covering the exposed flange of the insert with a decorative material.

3. Apparatus for holding plants, the apparatus comprising:

a basket having a bottom and a peripheral wall extending from the bottom and having an outward facing surface and an inner surface on the side of the wall opposite to the outward facing surface, the bottom and peripheral wall defining no more than one receptacle;

an insert configured to fit within the basket receptacle, the insert comprising:

a base, the object including at least one cavity for receiving an object; and a flange extending from the base, the flange having a free edge circumscribing the base, substantially the entire free edge of the flange intimately contacting a portion of the inner surface of the peripheral wall of the basket when the insert is placed within the basket so as to minimize lateral movement of the insert with respect to the basket.

4. The apparatus according to claim 3 wherein the base includes a plurality of cavities.

5. The apparatus according to claim 4 wherein at least two of the cavities have a different depth.

6. The apparatus of claim 3 wherein the cavities are of non-uniform size.

7. The apparatus of claim 4 wherein the cavities are of non-uniform size.

8. The apparatus of claim 3, wherein the receptacle of the basket has a bottom surface and wherein the at least one cavity comprises a cavity wall extending from the flange and a cavity bottom configured to rest on the bottom surface of the basket upon the insert being disposed within the basket.

9. The apparatus of claim 3 wherein the base includes five cavities.

10. The apparatus of claim 4 wherein the base includes three cavities.

11. The apparatus of claim 3 wherein the bottom of the insert defining the bottom of the cavities is continuous and hole-free.

12. The apparatus of claim 4 wherein the bottom of the insert defining the bottom of the cavities is continuous and hole-free.

13. The apparatus of claim 3, wherein the receptacle of the basket has a bottom surface and wherein the at least one cavity comprises a plurality of cavities including:

a first cavity having a cavity wall extending from the flange and a cavity bottom configured to rest on the bottom surface of the basket upon the insert being disposed within the basket; and a second cavity having a cavity wall extending from the flange and a cavity bottom supported above the bottom surface of the basket upon the insert being disposed within the basket.

14. A basket for receiving and holding standard sized pots, the basket comprising a top wall, a bottom wall, an outer peripheral wall having an outward facing surface and an inward facing surface on the side of the wall opposite to the outward facing surface, and no more than one concave interior portion, the top wall including at least two closed depressions, each defining a closed receptacle for receiving a standard sized pot, wherein the bottom and side walls are unitary and wherein the top wall extends from the inward facing surface of the outer peripheral wall over at least a portion of the concave interior of the basket.

15. The basket of claim 14 wherein the top wall, bottom and side walls are unitary.

16. The basket of claim 14 wherein the depressions are of non-uniform size.

17. The basket of claim 14 wherein the bottom of the top wall defining the bottom of the depressions is continuous and hole-free.

18. The basket of claim 14, wherein at least one of the depressions comprises a depression wall extending from the top wall and a depression bottom abutting the bottom wall of the basket.

19. In a basket having an outer peripheral wall defining an outer peripheral surface, an inner peripheral surface on the opposite side of the wall to the outer peripheral surface and no more than one concave interior section, the improvement comprising an insert for holding plants removably disposable within the basket and comprising:

a base, the base including at least two cavities for receiving plants; and a flange extending from the base adjacent the periphery of the cavities, the flange having a free edge circumscribing the base, wherein substantially the entire free edge abuts the inner peripheral surface of the outer peripheral wall, upon the insert being disposed within the basket, to minimize movement of the insert with respect to the basket.

20. The insert of claim 19 wherein the insert has a rectangular-shaped cavity.

21. The insert of claim 19 wherein the insert has three round cavities of one size and a fourth cavity of a larger size.

22. The insert of claim 19 wherein the insert has three cavities.

23. The insert of claim 19 wherein the insert has a square-shaped and a round-shaped cavity.

24. The apparatus of claim 19, wherein the concave interior of the basket has a bottom surface and wherein the at least one cavity comprises a plurality of cavities including:

a first cavity having a cavity wall extending from the flange and a cavity bottom configured to rest on the bottom surface of the basket upon the insert being disposed within the basket; and a second cavity having a cavity wall extending from the flange and a cavity bottom supported above the bottom surface of the basket upon the insert being disposed within the basket.

25. The insert of claim 19, wherein the basket defines a bottom surface at the bottom of the concave interior section and wherein at least one of the cavities comprises a cavity wall extending from the flange and a cavity bottom configured to rest on the bottom surface of the basket upon the insert being disposed within the basket.

26. Apparatus for holding plants, the apparatus comprising:

a basket having an outer peripheral wall having an outward facing surface and an inner surface on the opposite side of the wall to the side facing outward, the basket defining no more than one receptacle having a bottom surface;

an insert configured to fit within the basket receptacle, the insert comprising:

a base, the base including a plurality of cavities for receiving plants therein, the cavities having mutually differing sizes, each cavity having a peripheral wall and a bottom wall, the bottom wall of at least one cavity resting on the bottom surface of the basket when the insert is placed within the receptacle of the basket and the bottom wall of at least one other cavity being supported above the bottom surface of the basket when the insert is placed within the receptacle of the basket; and a flange extending from the base, a portion of the flange always contacting a portion of the inner surface of the outer peripheral wall of the basket when the insert is placed within the receptacle of the basket so as to minimize lateral movement of the insert with respect to the basket.

* * * * *